US005486401A

United States Patent [19]

Grant et al.

[11] Patent Number: 5,486,401

[45] Date of Patent: Jan. 23, 1996

[54] INSULATION ASSEMBLY AND METHOD OF MAKING

[75] Inventors: Larry J. Grant, Westerville; Raymond V. Monnin, Perrysburg; James W. Scott, Newark, all of Ohio

[73] Assignee: Owens-Corning Fiberglas Technology, Inc., Summit, Ill.

[21] Appl. No.: 239,820

[22] Filed: May 9, 1994

[51] Int. Cl.[6] ..... B32B 3/04

[52] U.S. Cl. ..... 428/125; 428/74; 428/192; 52/406.2

[58] Field of Search ..... 428/74, 125, 192; 52/406.2, 406.1; 264/118, 119

[56] References Cited

U.S. PATENT DOCUMENTS

| | | | |
|---|---|---|---|
| 3,518,157 | 6/1970 | Terry et al. | 161/170 |
| 3,549,738 | 12/1970 | Troyer | 264/119 |
| 4,038,356 | 7/1977 | Beranek et al. | 264/160 |
| 4,226,662 | 10/1980 | McCort | 156/390 |
| 5,139,839 | 8/1992 | Lim | 428/125 |

FOREIGN PATENT DOCUMENTS

| | | | |
|---|---|---|---|
| 1666669 | 7/1991 | U.S.S.R. | 52/406.2 |

*Primary Examiner*—Alexander S. Thomas
*Attorney, Agent, or Firm*—C. Michael Gegenheimer; Richard D. Emch

[57] ABSTRACT

An insulation assembly and method of making is disclosed. A fiber pack is engaged along its side edges to tuck the fibers inwardly and also establish a desired width. The insulation assembly has the longitudinally extending tucks along each of its side edges and each of the side edges has a generally concave cross section.

10 Claims, 4 Drawing Sheets

INSULATION ASSEMBLY AND METHOD OF MAKING

BACKGROUND ART

Insulation assemblies and, more particularly mineral fibers, including fibrous glass insulation assemblies are known in the art. Fibrous insulation assemblies are used for insulating buildings. The insulation assemblies take the form of batts or rolls which are compressed for packaging and transport. Many prior art insulation assemblies are sized along their side edges by slicing or cutting the side edges to the desired shape and width.

The present insulation assembly and method of making is directed to an improved insulation assembly which is not shaped along its side edges by cutting.

U.S. Pat. No. 5,277,955 granted Jan. 11, 1994 discloses a prior insulation assembly which includes a binderless fibrous batt.

DISCLOSURE OF THE INVENTION

The present invention relates to an improved insulation assembly and a method of making the assembly. A plurality of mineral fibers, such as glass fibers are placed on a generally horizontal path to form a pack. As the pack is moved along, the side edges of the pack are engaged to tuck or crease the fibers on the side edges inwardly. The formed pack is then cut to a predetermined length. In some embodiments, the formed pack is covered with a plastic layer. Creasing of the side edges forms concave surfaces on the side edges of the insulation assembly.

BEST MODE OF CARRYING OUT INVENTION

Figure 8:
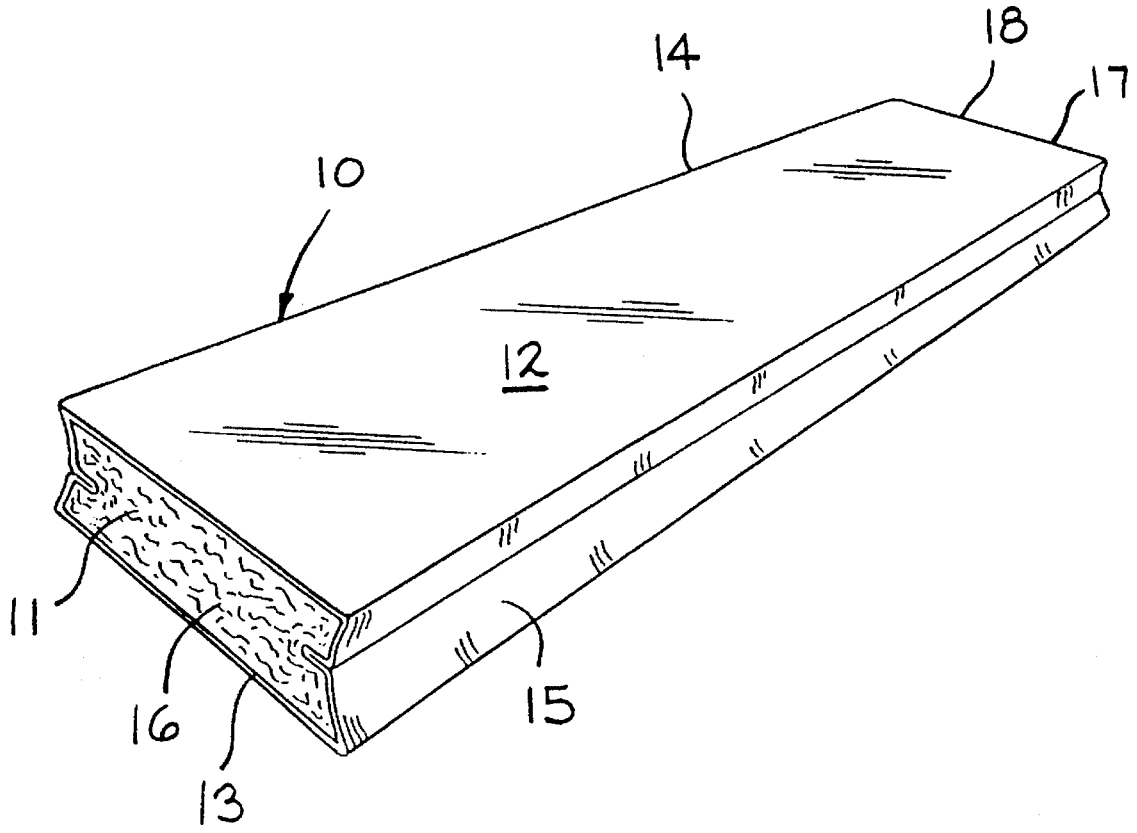
FIG. 8 is a perspective view of an insulation assembly, according to the present invention

An insulation assembly, according to the present invention, is generally indicated by the reference number 10 in FIG. 8. In the preferred embodiment, the insulation assembly is constructed from glass fibers. Other types of mineral fibers may also be utilized. The fibrous glass insulation assembly 10 includes a fibrous glass body 11 having a top surface 12, an opposed bottom surface 13, opposed side edges 14 and 15 and opposed ends 16 and 17. In the embodiment shown in FIG. 8, the insulation assembly 10 includes an outer plastic layer 18. The layer 18 covers the top surface 12, the bottom surface 13 and the opposed side edges 14 and 15. In the present embodiment, the ends 16 and 17 remain open. In other embodiments, not shown, the ends are also covered by the plastic layer 18.

Figure 5:
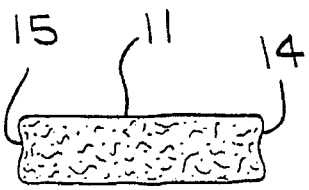
FIG. 5 is a cross-sectional view, taken along the line 5—5 of FIG. 2.
Figure 4:
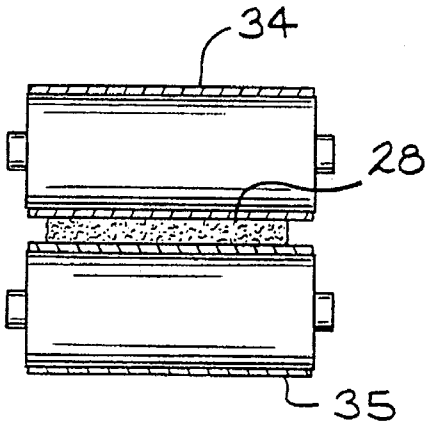
FIG. 4 is a cross-sectional view, taken along the line 4—4 of FIG. 2.

In still another embodiment, referring to FIG. 5, an outer plastic layer 18 is not provided and the fibrous glass body remains uncovered.

In the preferred embodiment, the outer plastic layer 18 is constructed from a polyethylene film having a thickness of 1.0 mil or less. The outer layer 18 can also be constructed from, for example polybutylene film, metalized film, Kraft paper or from non-woven materials. The outer layer 18 can also be constructed from combinations of materials.

Figure 1:
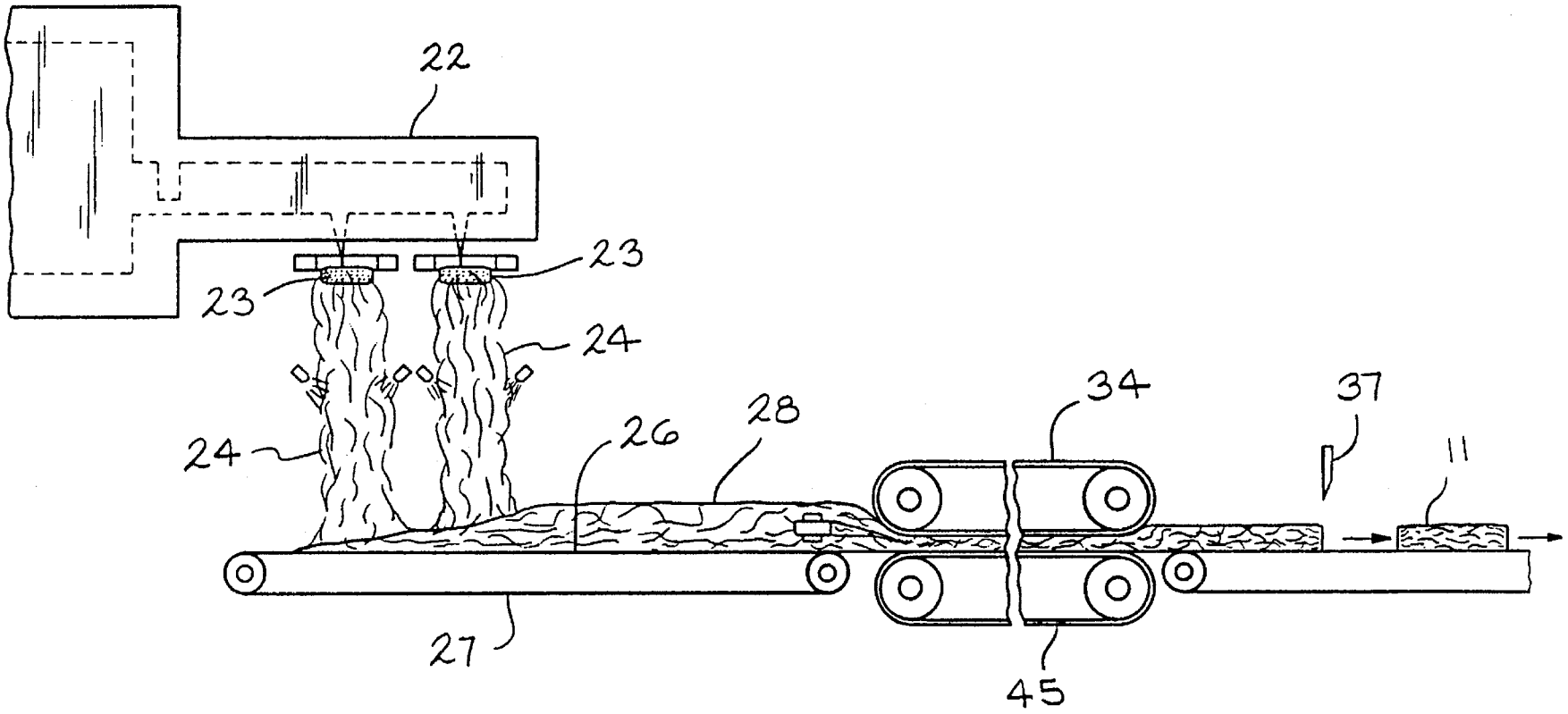
FIG. 1 is a diagrammatic elevational view showing the making of an insulation assembly, according to the present invention.

In the preferred embodiment, the glass fiber body 11 is constructed of a low density fibrous glass wool having a density of less than 1.5 pounds per cubic feet (24 kg/$M^3$). In the embodiment illustrated in FIG. 1, the glass fibers are manufactured by using a rotary process. Glass from a glass furnace 22 enters rotary spinners 23 where the glass is attenuated into veils of relatively long glass fibers 24. In other embodiments, the fibers can be other types of mineral fibers made from a process other than a rotary process.

In the preferred embodiment, the glass fibers 24 are of varying lengths. While a normal length range for fibers produced by the rotary process is between 2 inches and 10 inches, it is not unusual to have lengths of glass fibers over 18 inches long. In fact, lengths as high as 36 inches are not uncommon.

The glass fibers 24 are deposited on a generally horizontal path 26 defined by the upper surface of a conveyor 27. The fibers 24 form a glass fiber pack 28 as it moves along the path 26.

Figure 2:
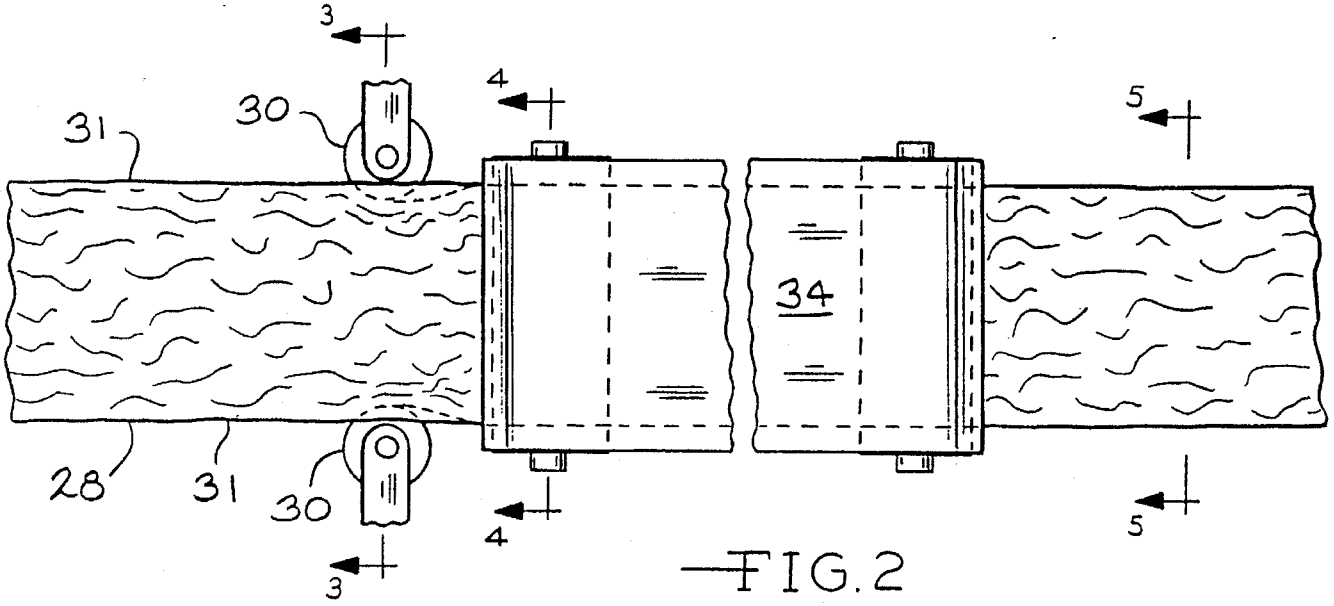
FIG. 2 is a plan view of the equipment shown in FIG. 1.
Figure 3:
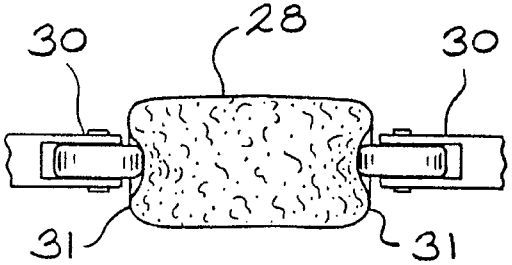
FIG. 3 is a cross-sectional view, taken along the line 3—3 of FIG. 2.
Figure 6:
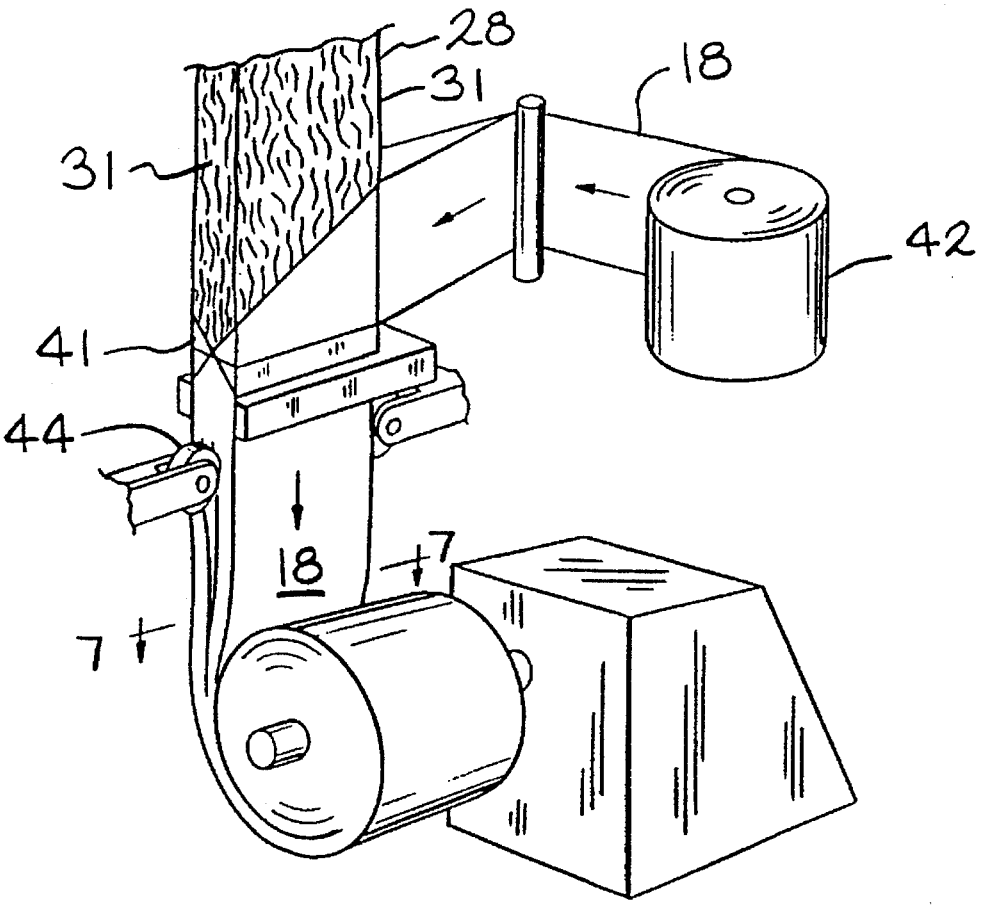
FIG. 6 is a diagrammatic view showing a plastic layer being applied to the formed insulation pack.

Referring to FIGS. 2 and 3, an important feature of the present invention is illustrated. A pair of shaping rollers 30 are positioned adjacent the side edges 31 of the pack 28. The shaping rolls 30 engage the side edges 31 and form a crease or tuck in the opposed side edges 31. In addition to the creasing, the shaping rolls 30 move the side edges 31 inwardly to form the desired width of the pack. In the prior art, width control normally included cutting a pack to a desired width. The pack then passes between a pair of shaping conveyors 34 and 35 to establish the correct height of the pack 28. A knife 37 which is perpendicular to the path 26 cuts the glass fiber pack 28 to a predetermined length to form the glass fiber body 11 of the insulation assembly 10.

Referring to FIG. 5, the body 11 of the insulation assembly 10 preferably has the longitudinal tucks or creases in its opposed side edges 14 and 15 and the side edges 14 and 15 preferably have a concave cross section. The tucks or creases are positioned in the center of the side edges 14 and 15 and extend longitudinally throughout the length of the glass fiber body 11.

When the assembly 10 is complete it is normally compressed for shipping to a distributor or to a job site. When the compressed assembly 10 is unrolled or uncompressed it recovers its thickness. It is not unusual to have a recovery rate of six to one the uncompressed thickness being six times the compressed thickness. When using the method of the present invention, it has been found that the recovery rate is increased normally five percent or more. This is important because the increased recovery rate means an increased insulation value.

The present method also results in an insulation assembly 10 which when uncompressed has a generally rectangular cross section. In some prior art methods, the insulation assembly had an generally oval cross section when uncompressed as opposed to the desired rectangular cross section.

Figure 7:
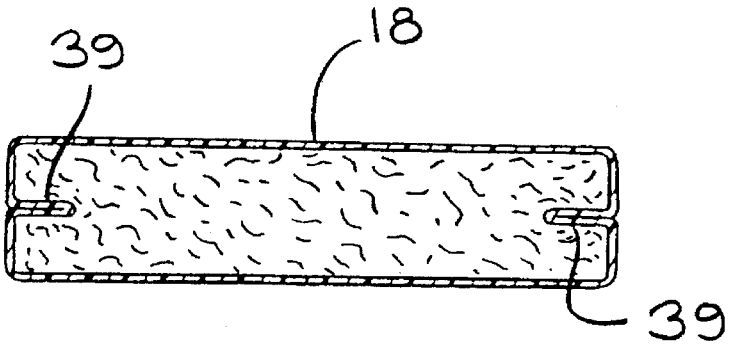
FIG. 7 is a cross-sectional view, shown on an enlarged scale, taken along the line 7—7 of FIG. 6.

FIG. 7 shows another embodiment of the present invention where the fibrous glass body 11 includes the outer plastic layer 18. In this embodiment, the crease or tuck in the side edges carries the outer plastic layer 18 inwardly forming flanges 39, as shown in FIG. 7.

In making the FIG. 7 embodiment, the glass fiber pack 28 is redirected downwardly through a shoe 41. A roll of plastic film 42 dispenses the plastic layer 18 through the shoe to encapsulate the formed glass fiber pack 28. Downstream from the shoe 41 a pair of opposed shaping rolls 44 engage the side edges 31 to form longitudinal creases or tucks. During the creasing of the side edges, the outer plastic layer 18 is tucked inwardly to form the opposed flanges 39, shown in FIG. 7.

Again, the shaping rolls 44 establish the correct width of the insulation assembly.

Many revisions may be made with respect to the above described best mode without departing from the scope of the invention or from the following claims.

We claim:

1. A non-rigid mineral fiber insulation assembly comprising, a fibrous body having opposed top and bottom surfaces, opposed side edges and opposed ends, each of said side edges including a longitudinally extending tuck, and each of said opposed ends being free of a transversely extending tuck.

2. A mineral fiber insulation assembly, according to claim 1, wherein said side edges have a concave cross section.

3. A mineral fiber insulation assembly, according to claim 1, including a plastic layer over said top and bottom surfaces and said side edges.

4. A mineral fiber insulation assembly, according to claim 3, wherein said plastic layer is tucked inwardly along each of said opposed side edges.

5. A mineral fiber insulation assembly, according to claim 4, wherein said plastic layer defines inwardly directed flanges along each of said side edges.

6. A mineral fiber insulation assembly, according to claim 1, wherein said mineral fiber insulation comprises a glass fiber insulation assembly.

7. A mineral fiber insulation assembly, according to claim 1, said fibrous body having a low fiber density.

8. A mineral fiber insulation assembly, according to claim 1 said fibrous body being recoverable from a compressed state.

9. A non-rigid mineral fiber insulation assembly, comprising, a fibrous body having opposed top and bottom surfaces, opposed side edges and opposed ends, each of said side edges including a longitudinally extending tuck, and each of said opposed ends being free of a transversely extending tuck, wherein said fibrous body is sufficiently pliable to be wound into a roll.

10. A non-rigid mineral fiber insulation assembly comprising, a fibrous body having opposed top and bottom surfaces, opposed side edges and opposed ends, each of said side edges including two opposing surfaces in contact to define a longitudinally extending tuck, and each of said opposed ends being cut and free of a transversely extending tuck.

* * * * *